US011707086B2

(12) United States Patent
Miller et al.

(10) Patent No.: US 11,707,086 B2
(45) Date of Patent: Jul. 25, 2023

(54) WASHING DEVICE AND SYSTEM FOR SMOKING DEVICES

(71) Applicants: Daniel Martin Miller, Chicago, IL (US); Jacob Avraham Miller, West Bloomfield, MI (US)

(72) Inventors: Daniel Martin Miller, Chicago, IL (US); Jacob Avraham Miller, West Bloomfield, MI (US)

( * ) Notice: Subject to any disclaimer, the term of this patent is extended or adjusted under 35 U.S.C. 154(b) by 0 days.

(21) Appl. No.: 17/805,564

(22) Filed: Jun. 6, 2022

(65) Prior Publication Data

US 2023/0180825 A1 Jun. 15, 2023

Related U.S. Application Data

(60) Provisional application No. 63/265,422, filed on Dec. 15, 2021.

(51) Int. Cl.

| | |
|---|---|
| ***A24F 9/12*** | (2006.01) |
| ***B08B 3/10*** | (2006.01) |
| ***B08B 3/04*** | (2006.01) |

(52) U.S. Cl.

CPC ..... *A24F 9/12* (2013.01); *B08B 3/044* (2013.01); *B08B 3/10* (2013.01)

(58) Field of Classification Search

None

See application file for complete search history.

(56) References Cited

U.S. PATENT DOCUMENTS

| | | | | |
|---|---|---|---|---|
| 1,052,759 | A * | 2/1913 | Shepherd | A24F 9/12 131/246 |
| 2004/0244824 | A1* | 12/2004 | Yasukawa | F26B 5/04 134/184 |
| 2016/0207167 | A1* | 7/2016 | Daykin | B08B 13/00 |
| 2021/0101190 | A1* | 4/2021 | Kawamori | B08B 3/02 |

* cited by examiner

*Primary Examiner* — Eric W Golightly

(74) *Attorney, Agent, or Firm* — Dunlap Bennett & Ludwig, PLLC

(57) ABSTRACT

A washing device and system is herein disclosed. The washing device includes a washing tub, a shaking system, a plate bracket, a first plate, a second plate, and a controller. The shaking system is mounted at a lower end of the washing tub. The plate bracket is mounted on the shaking system. The first plate defines a first set of holes and is movably mounted to a first side of the plate bracket. The second plate defines a second set of holes and is movably mounted to a second side of the plate bracket. The controller is operable to selectively activate and control the shaking system. In use, the first plate and the second plate support a smoking device therebetween, with cleaning fluid being agitated via the shaking system to clean the smoking device.

10 Claims, 3 Drawing Sheets

WASHING DEVICE AND SYSTEM FOR SMOKING DEVICES

CROSS-REFERENCE TO RELATED APPLICATION

This application claims the benefit of priority of U.S. provisional application No. 63/265,422, filed Dec. 15, 2021, the contents of which are herein incorporated by reference.

BACKGROUND OF THE INVENTION

The present invention relates to smoking devices and, more particularly, to a washing tub and system for smoking devices.

Currently, there is no effective and automatic way to wash a smoking device. These devices typically accumulate deposits of marijuana, tobacco, and other smokable matter that otherwise need to be manually cleaned/sanitized by hand. Existing devices are not designed to effectively clean bongs and other smoking devices. Most systems for cleaning are focused on specialized markets, like jewelry or medical supplies.

The smoking industry, in particular the medical marijuana industry, is growing rapidly. As can be seen, there is a need for a cleaning system tailored towards the cleaning and sanitization of smoking devices, as described herein. One object of the present invention is to provide a product that allows any bong or other smoking device size up to 2 feet tall to get soaked and shaken safely with any detergent or soak ingredient. This allows the smoking device to be cleaned without manually getting a user's hands dirty shaking/cleaning the smoking device.

SUMMARY OF THE INVENTION

In one aspect of the present invention, a washing device comprises: a washing tub; a shaking assembly mounted at a lower end of the washing tub; a plate bracket mounted on the shaking system; a first plate that defines a first plurality of holes and is movably mounted to a first side of the plate bracket; a second plate that defines a second plurality of holes and is movably mounted to a second side of the plate bracket; and a controller for selectively activating and controlling the shaking assembly, wherein the first plate and the second plate are configured to support a smoking device therebetween.

In another aspect of the present invention, a washing system comprises: a smoking device; a fluid; washing device comprising: a washing tub retaining the fluid; a shaking assembly mounted at a lower end of the washing tub; a plate bracket mounted on the shaking system; a first plate that defines a first plurality of holes and is movably mounted to a first side of the plate bracket; a second plate that defines a second plurality of holes and is movably mounted to a second side of the plate bracket; and a controller for selectively activating and controlling the shaking assembly, wherein the first plate and the second plate support the smoking device therebetween.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the present invention. The description is not to be taken in a limiting sense but is made merely for the purpose of illustrating the general principles of the present invention, since the scope of the present invention is best defined by the appended claims.

Broadly, an embodiment of the present invention provides a washing tub for smoking devices. Embodiments of the present invention allow a user to shake a glass bong or other smoking device easily without it breaking by slidably engaging two plates with opposing sides of the bong or other smoking device. This applies a compressive force by the plates to the smoking device to prevent it from unwanted movement while the tub is in use. The plates include holes passing through the plates. The bong or other smoking device may then be shaken by the plates in an emersion of a cleansing solution, chosen by the consumer or provided as part of an overall system.

Figure 1:
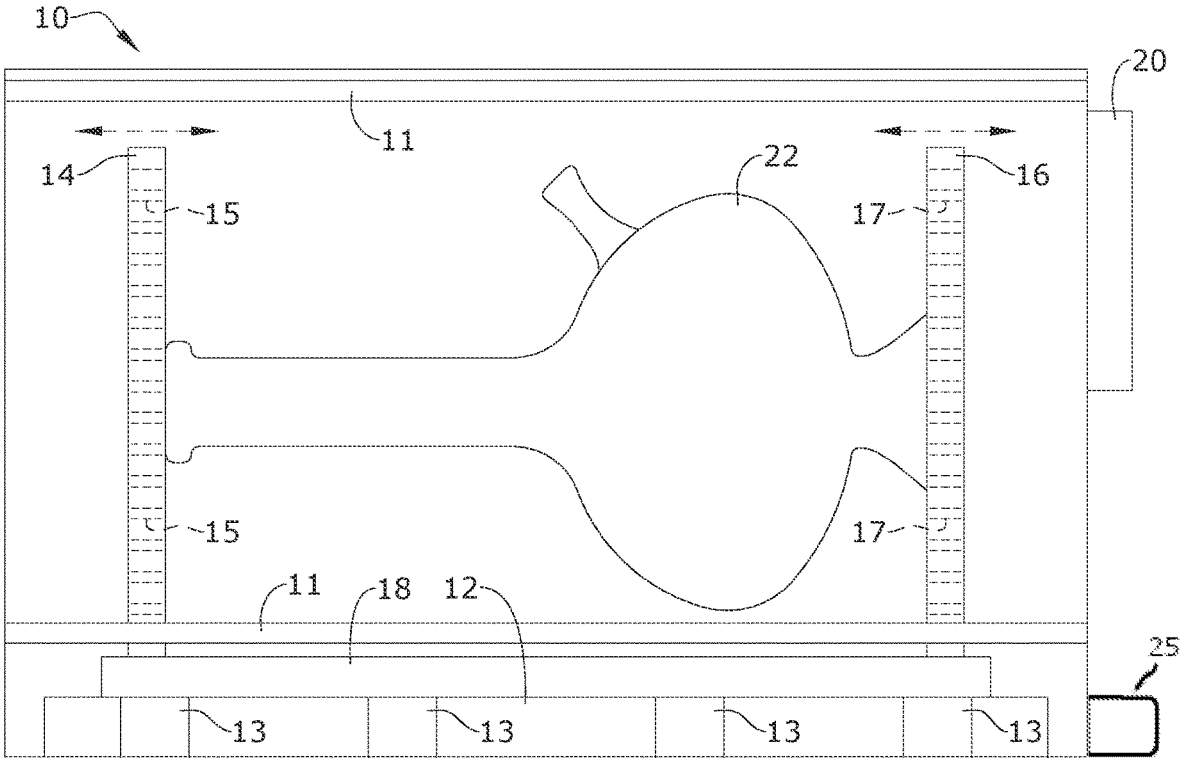
FIG. 1 is a schematic side view of an embodiment of the present invention.
Figure 2:
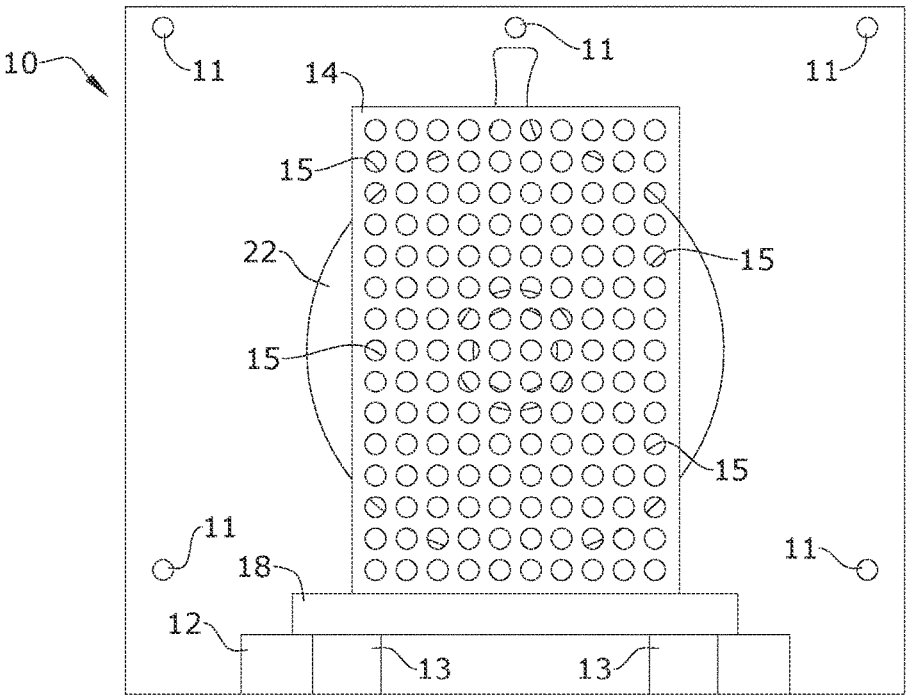
FIG. 2 is a schematic left view of the embodiment of the present invention.

Referring now to FIGS. 1-4, a washing device is provided that includes a washing tub 10 that is provided that has a plurality of ultraviolet (UV) lights 11 at an upper and/or lower end thereof, a shaking system 12 (also referred to, herein, as a shaking assembly), transducers 13 (optionally provided), a first plate 14 and second plate 16 extending vertically from a plate bracket 18, and a controller 20. As shown in FIGS. 1 and 2, the first plate 14 defines a plurality of first plate holes 15 and the second plate 16 defines a plurality of second plate holes 17. The shaking system 12 may be comprised of, for example, motors mounted in a housing, with the motors being configured to vibrate the housing and the plate bracket 18 (which, in turn, shakes the first and second plates 14, 16). The shaking system 12 and plates 14, 16 are configured such that a smoking device 22 can be shaken without the smoking device 22 breaking. The transducers 13 provide for ultrasonic cleaning capability by creating a specific frequency in a cleaning solution 24 or other liquid retained in the tub 10.

As shown in FIG. 1, in use, a glass smoking device 22 (e.g., a bong or the like) is placed into a washing tub 10 (which is dimensioned to accommodate various size smoking devices 22). The washing tub 10 may be filled with an appropriate cleaning solution/substance 24 (such as a detergent). The smoking device 22 is fit between the first plate 14 and second plate 16, which are slidably engaged with the plate bracket 18. As denoted by the directional arrows in FIG. 1, the two plates 14, 16 are laterally adjustable towards and away from one another to secure the smoking device 22 in position with sufficient strength that when it's shaken it does not move in place. Thus, various size smoking devices 22 can be securely retained by the plates 14, 16, and these devices 22 can be shaken more strongly than otherwise possible, in a controlled manner (e.g., if it was simply sitting on top of a shaker unsupported, strong shaking could result in fracture of the smoking device 22).

Figure 3:
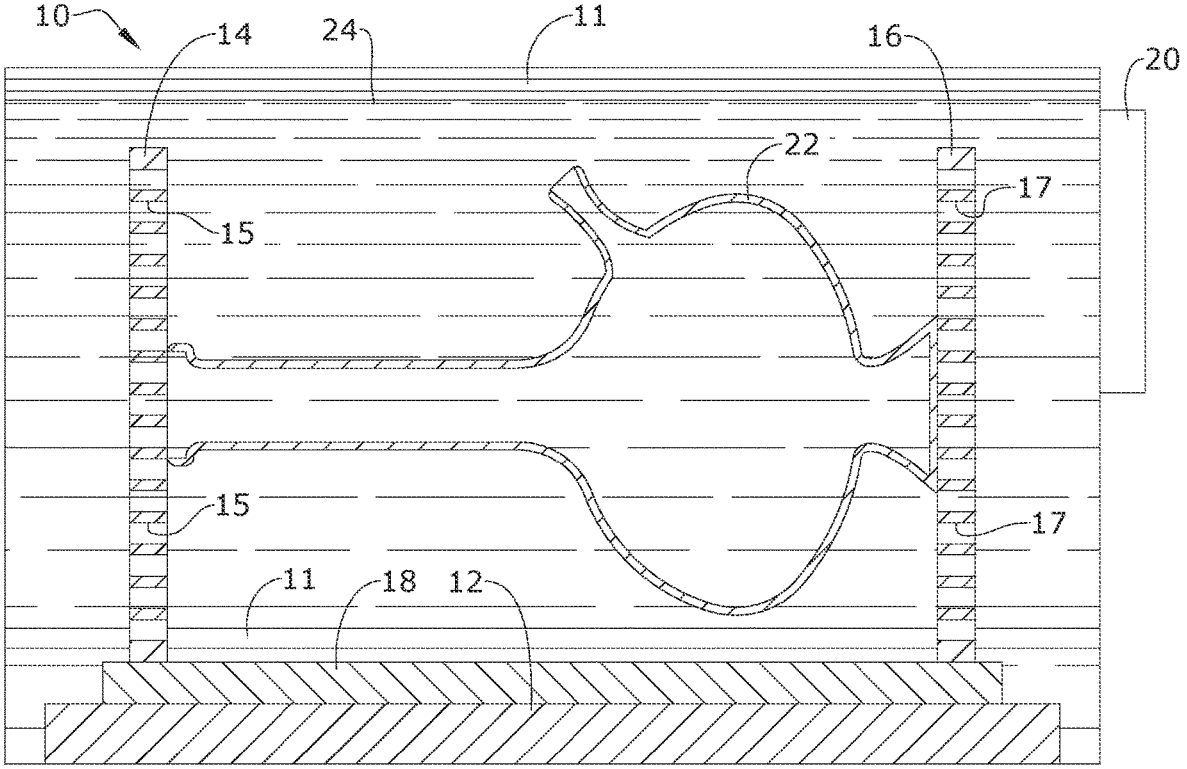
FIG. 3 is a schematic section view of the embodiment of the present invention.

As generally illustrated in FIGS. 2 and 3, the plurality of small holes 15, 17 on each side of the plates 14, 16 are provided so that water and other cleaning liquids/solutions 24 can pass therethrough and into/out of the smoking device 22 for superior cleansing. A user can utilize the controller 20 (it may be embodied as a computer with a processor and memory with a user interface, for example) to select the amount of washing time and cycles of the washing tub 10. After initialization by the controller 20, the shaking system 12 then shakes the device 22 for the selected time and cycles. The UV lights provide additional sanitization of the smoking device 22.

Figure 4:
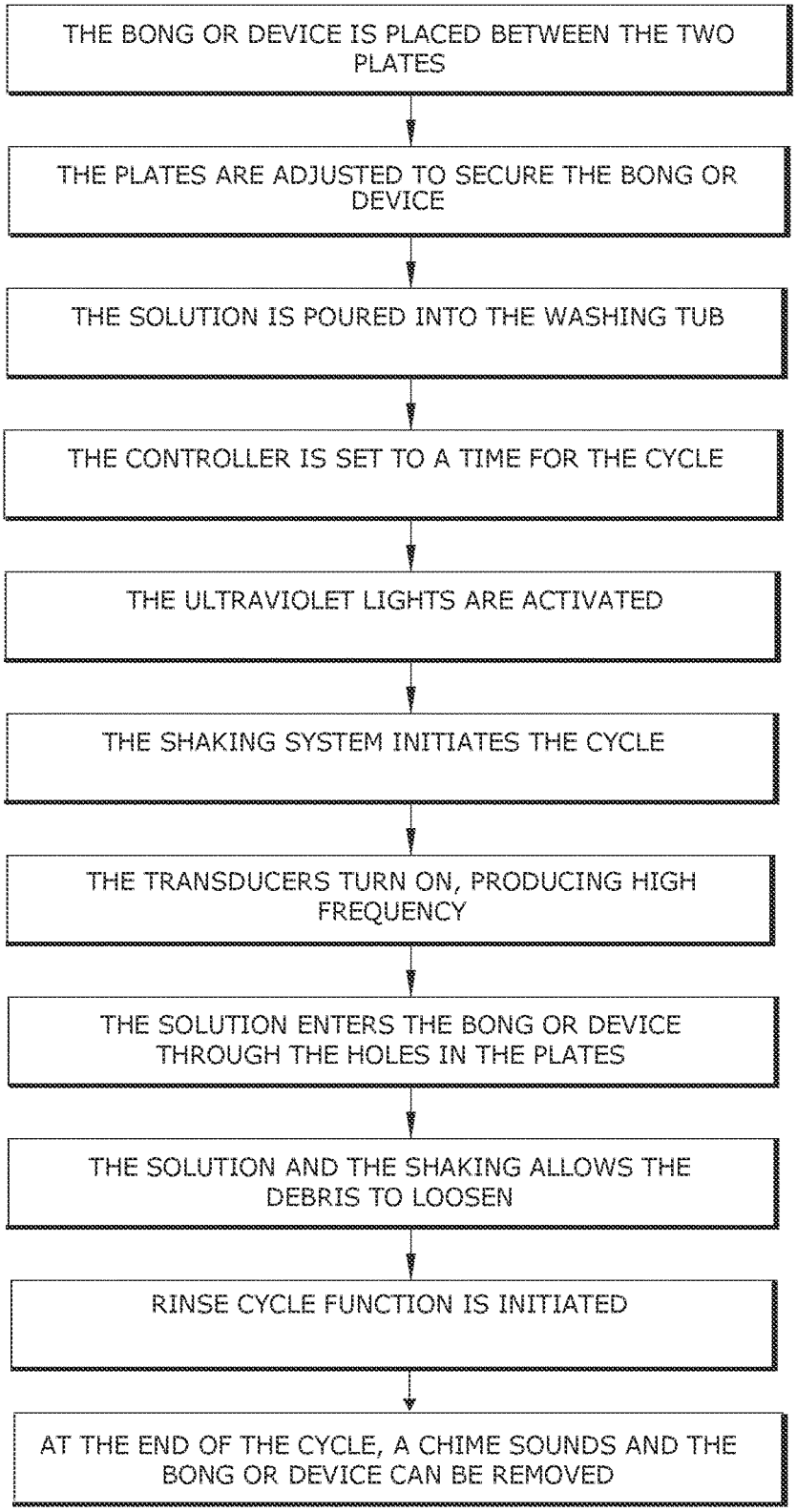
FIG. 4 is a flow chart of the embodiment of the present invention.

In an exemplary embodiment, and as described FIG. 4, the washing device may be used as follows. First, the bong or smoking device 22 is placed between the two plates 14, 16. The plates are laterally adjusted to secure the smoking device 22 in place. Cleaning solution 24 is added to the tub 10. A user may use the controller 20 to set a time for the cleaning cycle. Once a time is set, the washing tub's shaking system 12 will then start shaking the bong/smoking device 22 and cleaning it using the shaking method within the solution 24 of user's choice. Concurrently or immediately prior to activation of the shaking system 12, the ultraviolet lights 11 are activated to sanitize the smoking device 22. Initiation of the cleaning cycle also turns on the transducers 13, producing high frequency. Due to the agitation of the solution 24, the cleaning solution 24 enters in and out of the smoking device 22 via the plate holes 15, 17. The combination of the solution 24 and the shaking allows any debris/particulates to loosen from the smoking device 22. The tub 10 may be further configured to include a rinse cycle function. The controller 20 controls the cycles and how long to shake the smoking device in the substance for. If this rinse cycle is selected via the controller 20, the solution 24 (or other fluid) is drained out a lower end of the tub 10 via a drain 25, and water may be jetted back into the tub 10 to rinse the smoking device 22. In this step, similar shaking of the smoking device 22 with the jetted in water may occur to thoroughly rinse the smoking device 22. Once any and all cycles are complete, the tub 10 will play a noise and the cycle will be complete. Users can customize timing settings as each water bong or other smoking device 22 will be different (e.g., different sizes/shapes) and need more or less time.

In alternative embodiments, the controller 20 may be embodied to slowly robotically adjust the spacing of the plates 14, 16 based on size of the water bong or other smoking device 22 once the bong is set, with the controller 20 gently closes the plates 14, 16 on the smoking device 22 to lock it in place.

In addition to the above, in an exemplary embodiment, the washing device may be made, assembled, and used as follows. The two plates 14, 16 may be provided on a metal pole that allows it to be adjusted based on the size of the smoking device 22 (e.g., see the directional arrows in FIG. 1), or they may be otherwise slidably engaged with the plate bracket 18. The plate bracket 18 sits on top of a shaker system 12, which may have transducers 13 embedded therewithin. The shaker system 12 is mounted at a lower end of the washing tub 10. This resulting assembly is mounted within main vessel of the tub 10. A controller 20 can be mounted on an outer portion of the main vessel, and a drain 25 can be formed at a lower end thereof. In certain embodiments, the drain 25 can be opened/closed by the controller 20, as described above.

All elements, in general, are essential aspects of the present invention as they contribute to the overall functionality. However, those with skill in the art will appreciate that various modifications may be made while still resulting in the same overall functionality. Further, there may be an additional ionizer element integrated that would make the process easier to remove the dirt within the bong using ions, but that may be a premium option upgrade later developed and integrated. Even further, an agitating accessory device may be integrated, as an upgrade, through the front plate leading inside the bong to agitate the liquid improving cleaning process. That accessory device may be connected either by the main box or through outside accessory panel. Even further, those with skill in the art will appreciate that the present invention may be used for other purposes, including, but not limited to, cleaning other glassware (e.g., a flower vase) and ceramic products.

The present invention has been described in terms of exemplary embodiments solely for the purpose of illustration. Persons skilled in the art will recognize from this description that the invention is not limited to the embodiments described but may be practiced with modifications and alterations limited only by the spirit and scope of the appended claims.

What is claimed is:

1. A washing device comprising:
- a washing tub;
- a shaking system mounted at a lower end of the washing tub;
- a plate bracket mounted on the shaking system;
- a first plate that defines a first plurality of holes and is movably mounted to a first side of the plate bracket;
- a second plate that defines a second plurality of holes and is movably mounted to a second side of the plate bracket; and
- a controller for selectively activating and controlling the shaking system,
- wherein the first plate and the second plate are configured to support a smoking device therebetween.

2. The washing device of claim 1, wherein, in use, the first plate and the second plate are slidably movable to engage opposing sides of the smoking device.

3. The washing device of claim 2, wherein the shaking system is configured to shake the plate bracket, with the plate bracket being configured to shake the first plate and the second plate.

4. The washing device of claim 3, further comprising a drain at a lower end of the washing tub.

5. The washing tub of claim 4, further comprising a plurality of ultraviolet lights mounted in the washing tub.

6. A washing system comprising:
- a smoking device;
- a fluid;
- washing device comprising:
  - a washing tub retaining the fluid;
  - a shaking system mounted at a lower end of the washing tub;
  - a plate bracket mounted on the shaking system;
  - a first plate that defines a first plurality of holes and is movably mounted to a first side of the plate bracket;
  - a second plate that defines a second plurality of holes and is movably mounted to a second side of the plate bracket; and
  - a controller for selectively activating and controlling the shaking system,
- wherein the first plate and the second plate support the smoking device therebetween.

7. The washing system of claim 6, wherein, the first plate and the second plate are slidably movable to engage opposing sides of the smoking device.

8. The washing system of claim 7, wherein the shaking system is configured to shake the plate bracket, with the plate bracket being configured to shake the first plate and the second plate.

9. The washing system of claim 8, wherein shaking of the first plate and the second plate results in the fluid passing bidirectionally through the first plurality of holes and the second plurality of holes to clean the smoking device.

10. The washing system of claim 9, further comprising a drain at a lower end of the tub, with the drain being openable and closable via the controller to selectively drain the fluid from the washing tub.

* * * * *